United States Patent [19]

Malghan

[11] Patent Number: 4,545,896

[45] Date of Patent: Oct. 8, 1985

[54] UPGRADING CONCENTRATES OF PARAMAGNETIC SULFIDE MINERALS

[75] Inventor: Subhaschandra G. Malghan, Cypress, Tex.

[73] Assignee: Exxon Research and Engineering Co., Florham Park, N.J.

[21] Appl. No.: 593,504

[22] Filed: Mar. 26, 1984

[51] Int. Cl.[4] ..... B03B 1/00

[52] U.S. Cl. ..... 209/5; 209/8; 209/214

[58] Field of Search ..... 209/3, 4, 5, 8, 10, 209/212-215; 210/695

[56] References Cited

U.S. PATENT DOCUMENTS

| | | | |
|---|---|---|---|
| 3,289,836 | 12/1966 | Weston | 209/214 |
| 3,471,011 | 10/1969 | Iannicelli et al. | 209/214 |
| 3,826,365 | 7/1974 | Mercada | 209/5 |
| 3,853,983 | 10/1974 | Abercrombie et al. | 423/113 |
| 3,887,457 | 6/1975 | Marston et al. | 209/214 |
| 3,902,994 | 9/1975 | Maxwell et al. | 209/213 |
| 4,116,829 | 9/1978 | Clark et al. | 210/42 |
| 4,239,529 | 12/1980 | Klindig et al. | 209/214 |
| 4,272,029 | 6/1981 | Weston | 209/3 |

FOREIGN PATENT DOCUMENTS 2412787 10/1974 Fed. Rep. of Germany ..... 209/5

*Primary Examiner*—Bernard Nozick

*Attorney, Agent, or Firm*—Joseph J. Dvorak

[57] ABSTRACT

The present invention provides a process for separating a concentrate containing two or more minerals having substantially similar paramagnetic properties by treating the minerals particles with a dispersing agent so as to maintain the particles adequately dispersed during a subsequent magnetic separation step. Thus, in one embodiment of the present invention a method is provided for separating sulfide concentrate into at least two fractions. The process comprises obtaining a slurry of the sulfide minerals particles, adding a dispersing agent to the slurry so as to maintain the particles in the slurry dispersed during a subsequent magnetic separation step and thereafter passing the so dispersed particle slurry to a high gradient magnetic field whereby the more magnetic particles are retained within the field and the less magnetic particles pass therethrough thereby affecting separation.

6 Claims, No Drawings

UPGRADING CONCENTRATES OF PARAMAGNETIC SULFIDE MINERALS

FIELD OF THE INVENTION

The present invention relates to upgrading a mixture of sulfide minerals particles into individual mineral concentrates. More particularly, the present invention relates to separating a mixture of particles, such as particles of sulfide minerals, using high gradient magnetic separation techniques.

BACKGROUND OF THE INVENTION

In the recovery of metal values from ores, such as sulfide ores, the ore is typically crushed, wet ground and classified as to particle size. The ground and sized ore is then slurried with additional water, if required, to form a pulp and the pulp is thereafter conditioned for flotation. After flotation, the separated float or mineral concentrate typically is further processed for recovery of the metal values in the concentrate. Of course, there is a metal value in the concentrate below which metal recovery therefrom becomes uneconomical. For example, in lead concentrates, if the level of lead is below about 45%, the recovery of lead therefrom becomes generally uneconomical and the concentrate is considered to be a low grade concentrate. Such low grade concentrates may, of course, be subjected to additional flotation to further enhance or upgrade the quality of the concentrate so that it may be economically processed for recovery of the metal values therefrom. Unfortunately such subsequent separation and processing can be inefficient and expensive. This is so, for example, with lead concentrates containing galena, pyrite, sphalerite and chalcopyrite. Also, the reagents that are used in such processing of low grade concentrates are more expensive and in some instances present environmental hazards which further increase the costs of processing the low grade concentrates so as to upgrade it.

Many clays and ores have been upgraded by use of magnetic separation techniques. Examples of such methods and apparatus for use in such methods are set forth in the following U.S. Pat. Nos.: 3,826,365; 3,887,457; 4,116,829; 3,853,983; 3,902,994 and 3,289,836. In each instance the materials being separated have widely different magnetic properties and in most instances one of the materials is present as an impurity, i.e., at exceedingly low concentrations.

In sulfide concentrates, such as lead concentrates containing galena, pyrite, sphalerite, molybdenite, and chalcopyrite, the minerals in the concentrate have substantially similar paramagnetic properties. Thus, it has not been possible to separate these concentrates by high gradient magnetic separation techniques due to the problems related to the magnetic matrix saturation and entrapment of unwanted particles. Consequently, there remains a need for separating mixtures of particles of substantially similar paramagnetic properties.

SUMMARY OF THE INVENTION

In its simplest sense, the present invention provides a process for separating a concentrate containing two or more minerals having substantially similar paramagnetic properties by treating the minerals particles with a dispersing agent so as to maintain the particles adequately dispersed during a subsequent magnetic separation step. Thus, in one embodiment of the present invention a method is provided for separating sulfide concentrate into at least two functions. The process comprises obtaining a slurry of the sulfide mineral particles, adding a dispersing agent to the slurry so as to maintain the particles in the slurry dispersed during a subsequent magnetic separation step and thereafter passing the so dispersed particle slurry to a high gradient magnetic field whereby the more magnetic particles are retained within the field and the less magnetic particles pass therethrough thereby affecting separation.

DETAILED DESCRIPTION OF THE INVENTION

The invention has particular utility to the upgrading of sulfide minerals concentrates. Consequently, the invention will be described with particular reference to the separation of sulfide concentrates into at least two fractions, thereby upgrading the quality of the resulting sulfide mineral concentrate. However, it should be readily apparent to anyone skilled in the art that the subject invention is equally applicable to the separation of mixtures of other paramagnetic minerals which contain sulfides as one of the components in to at least two fractions.

The first step in upgrading low grade sulfide concentrates is to obtain a slurry of the concentrate. Thus, the sulfide mineral is ground to a liberation particle size generally in the range of about 200 to 10 microns and thereafter mixed with a nonmagnetic fluid vehicle, such as water. Typically, the slurry will contain in the range of about 2 to 50 weight percent of solids and preferably in the range of about 5 to 20 weight percent of solids.

After slurrying the particles in an appropriate vehicle, the dispersing agent is added. Any material which will keep the solid particles of the ore dispersed in the liquid vehicle for a time sufficient to treat the suspended particles in a magnetic field so as to effect the separation is acceptable. In the separation of sulfide minerals typical dispersing agents include phosphates, silicates and acrylates. Indeed, particularly preferred dispersing agents include sodium hexametaphosphate, sodium silicate, sodium sulfide and low molecular weight polyacrylates.

In general, the amount of dispersing agent used is such that it will disperse the particles in the liquid vehicle for a time sufficient to subsequently treat the dispersion in a high gradient magnetic field. A very simple test as to the adequacy and amount of the dispersing agent is to add the dispersing agent to a minus 10 micron slurry of the particles in a cylinder and if no significant settling occurs within half an hour, the amount and nature of the dispersing agent is generally adequate. Typically the amount of dispersing agent satisfactory in the practice of the present invention will range from about 1.0 to about 5.0 kg/t of mineral concentrate.

After dispersing the particles in the liquid media, the slurry is fed through a high gradient magnetic field of a high gradient magnetic separator. As the material passes through the field particles with higher magnetic susceptibility will be retained within the magnetic field and the particles with lesser magnetic susceptibility will pass through thereby affecting a separation. The magnetic particles retained within the field, of course, may be subsequently removed from the field by well known techniques.

In order to more fully illustrate the process of the present invention, the separation set forth in the following examples were achieved. In these examples, the magnetic unit used to achieve the separation was a 10-15-20 Model sold by Sala Magnetics of Massachusetts. Basically this unit includes a ferro-magnetic matrix material in the form of steel wool packed into a 3.8 cm diameter by 36 cm long canister in which the matrix material occupies 15 cm in length. The field strength of the unit can be varied from 0.9 to 22 kilogauss. The unit was equipped with a valve which permitted control of the flow rate of the feed through the matrix in the range of about 30 to 150 mm/sec.

In the examples which follow, the operative procedure consisted of introducing a well dispersed slurry of sulfide mineral concentrate into an agitated hopper which feeds into the magnetised matrix. After adjusting the field strength and flow rate to the desired levels, the feed is passed through the magnetised matrix. The more magnetic particles remain in the matrix while the less magnetic ones pass through the matrix and collect as a non-magnetic fraction. To release mechanically entrained with water. Thereafter the magnetic field was allowed to collapse and the magnetic particles were recovered as a separate fraction.

EXAMPLE 1

In this example, galena was separated from pyrite in a low lead concentrate containing galena, pyrite, sphalerite and chalcopyrite. The feed had the following analysis: 34.6% Pb, 19.6% Fe, 8.95% Zn and 2.3% Cu. The feed, with particle size of minus 105 microns (140 U.S. mesh), was slurried in water to yield a 20% by weight slurry and then agitated for 30 minutes with 1.0 kg/t sodium hexametaphosphate, a dispersing agent. A sample of the dispersed slurry was placed in a cylinder and it was observed that the particles remained substantially dispersed for a period of ½ hours.

This dispersed slurry was thereafter subjected to a single stage high gradient magnetic separation using the following conditions: matrix No. 1/0, field strength 21.5 kilo-gauss, matrix loading 0.371 g/g and flow rate of 88 mm/s. The results of the separation are given in Table 1 below.

TABLE 1

| | | Assay % | | % Distribution | |
|---|---|---|---|---|---|
| Product | Wt. % | Pb | Fe | Pb | Fe |
| Pyrite Concentrate (more magnetic) | 62.2 | 21.4 | 22.6 | 36.8 | 73.8 |
| Galena Concentrate (less magnetic) | 37.8 | 60.6 | 13.2 | 63.2 | 26.2 |

As shown above, the galena was separated with the less magnetic product containing 63.2% of the total lead in a concentrate assaying 60.6%.

To further increase galena recovery, the magnetic fraction was reground to minus 38 microns to liberate galena from pyrite. The ground product was subjected to high gradient magnetic separation. The resulting less magnetic fraction was combined with the less magnetic fraction described above in Table 1 to yield a total lead recovery of 87.0% at a concentrate grade of 50% Pb. Hence these data show that the grade of lead concentrate, a less magnetic product, can be increased from 34.6% Pb to 50% Pb, without sacrificing the recovery significantly.

EXAMPLE 2

In this example, chalcopyrite was separated from molybdenite in a concentrate containing pyrite and siliceous gangue as impurities. The feed material had the following assay: 25.7% Cu, 0.26% MO. The feed was ground to 80% passing 200 mesh, slurried to 20% solids by weight to which was added 2.0 kg/t sodium hexametaphosphate as a dispersing agent. The sodium hexametaphosphate had the ability to maintain the particles dispersed for a period over ½ hour. The dispersion was subjected then to a single stage high gradient magnetic separation under the conditions: matrix 1/0, field strength 10 kilo-gauss, matrix loading 0.26 g/g, and flow rate 100 mm/s. The resulting separation of the material into more magnetic and less magnetic material is given in the Table 2 below.

TABLE 2

| | | Assay % | | % Distribution | |
|---|---|---|---|---|---|
| Product | Wt. % | Cu | Mo | Cu | Mo |
| More Magnetic | 54.6 | 32.4 | 0.07 | 68.8 | 14.4 |
| Less Magnetic | 45.4 | 17.7 | 0.5 | 31.2 | 85.6 |

The less magnetic fraction contained most of the molybdenum and some of the copper. To recover copper from the less magnetic fraction one more stage of separation would be necessary.

EXAMPLE 3

In this example, galena was separated from chalcopyrite. The feed had the following composition: 8.5% copper, 11.5% lead. The feed was ground to 80% passing 53 micron particle size and slurried in water to 20% solids, and then dispersed with 1.5 kg/t sodium hexametaphosphate as a dispersing agent. The dispersion was thereafter treated in a single stage high gradient magnetic separator using a 1/0 matrix, a 100 mm/s flow rate and a 20 kilo-gauss field strength. The results are given below in Table 3.

TABLE 3

| | | Assay % | | % Distribution | |
|---|---|---|---|---|---|
| Product | Wt. % | Cu | Pb | Cu | Pb |
| More Magnetic | 63.3 | 12.5 | 5.7 | 92.9 | 31.4 |
| Less Magnetic | 36.7 | 1.66 | 21.5 | 7.1 | 68.6 |

The more magnetic concentrate contains most of the copper while Pb assay of the concentrate is four times smaller than that of the less magnetic fraction. To recover the remaining Pb from the more magnetic fraction, another pass through the separator would be needed.

EXAMPLE 4

This example illustrates the separation of chalcopyrite from pyrite from low grade copper concentrates. The feed having the following composition was employed: 23.4% copper, 33.3% iron. The feed had a particle size of 80% passing 53 microns and it was slurried in water to 20% solids to which was added a 2.0 kg/t sodium hexametaphosphate and 1.0 kg/t sodium silicate as dispersng agents. Thereafter the material was subjected to high gradient magnetic separation following the procedures outlined above, the results are given in Table 4 below.

TABLE 4

| | | Assay % | | % Distribution | |
|---|---|---|---|---|---|
| Product | Wt. % | Cu | Fe | Cu | Fe |
| More Magnetic | 79.2 | 26.7 | 30.8 | 90.2 | 73.2 |

TABLE 4-continued

| Product | Wt. % | Assay % | | % Distribution | |
|---|---|---|---|---|---|
| | | Cu | Fe | Cu | Fe |
| Less Magnetic | 20.8 | 11.0 | 42.8 | 9.8 | 26.8 |

The more magnetic fraction upgraded from 23.4% Cu to 26.7% Cu at 90.2% recovery, while the iron assay decreased from 33.3 to 30.8% Fe.

What is claimed is:

1. A process for upgrading low grade sulfide mineral concetrates selected from lead concentrates containing galena and pyrites, copper concentrates containing chalcopyrite and molybdenite, and copper concentrates containing galena and chalcopyrite by separating said concentrate into at least two fractions comprising:

obtaining a slurry of from 2 wt% to 50 wt% of said concentrate;

adding a dispersing agent to said concentrate in an amount ranging from about 1.0 to about 5.0 kg/t of mineral concentrate, said dispersing agent being selected from dispersing agents which when added to a sample slurry of particles maintain said particles substantially dispersed for about ½ hour; and passing said slurry through said high gradient magnetic field at feed rates of about 30 to 150 mm/sec whereby the more magnetic pyrite or chalcopyrite material in said slurry is retained in said field and the less magnetic galena or molybdenite material in said slurry passes through thereby affecting a separation of said slurry into at least two fractions at least one of which is upgraded.

2. The process of claim 1 wherein said dispersing agent is sodium hexametaphosphate when said concentrate is a lead concentrate containing galena and pyrite, and sodium hexametaphosphate and sodium silicate wherein said concentrate is a copper concentrate containing chalcopyrite and pyrite and silicate minerals.

3. The process of claim 1 wherein said dispersing agent is selected from the group consisting of phosphates, silicates, and acrylates.

4. The process of claim 3 wherein said dispersing agent is sodium hexametaphosphate.

5. The process of claim 3 wherein said dispersing agent is sodium silicate.

6. The process of claim 3 wherein said dispersing agent is an acrylate.

* * * * *